US009320377B2

(12) United States Patent
Link et al.

(10) Patent No.: US 9,320,377 B2
(45) Date of Patent: Apr. 26, 2016

(54) COMBINATION BOOT JACK, BOOT TRAY, AND BOOT RACK

(71) Applicants: Jeffrey S. Link, Verona, VA (US); Paula O. Link, Verona, VA (US)

(72) Inventors: Jeffrey S. Link, Verona, VA (US); Paula O. Link, Verona, VA (US)

( * ) Notice: Subject to any disclaimer, the term of this patent is extended or adjusted under 35 U.S.C. 154(b) by 0 days.

(21) Appl. No.: 14/120,072

(22) Filed: Apr. 23, 2014

(65) Prior Publication Data

US 2015/0305536 A1 Oct. 29, 2015

(51) Int. Cl.
*A47G 25/80* (2006.01)
*A47G 25/86* (2006.01)

(52) U.S. Cl.
CPC ..... *A47G 25/86* (2013.01)

(58) Field of Classification Search
CPC ..... A47G 25/80; A47G 25/86
USPC ..... 223/113, 114
See application file for complete search history.

(56) References Cited

U.S. PATENT DOCUMENTS

| | | | | | |
|---|---|---|---|---|---|
| 544,063 | A | * | 8/1895 | Jacks | 223/115 |
| 611,043 | A | * | 9/1898 | Spaid | 223/116 |
| 612,764 | A | * | 10/1898 | Anderson | 223/117 |
| 2,725,167 | A | * | 11/1955 | Barnes | 223/113 |
| 3,623,640 | A | * | 11/1971 | Zalejski | 223/114 |
| 3,784,067 | A | * | 1/1974 | Hicks | 223/114 |
| 3,964,117 | A | | 6/1976 | Fox | |
| 4,135,652 | A | | 1/1979 | Patton | |
| 4,262,828 | A | * | 4/1981 | Kosakai | 223/115 |
| 4,667,861 | A | * | 5/1987 | Harrington et al. | 223/113 |
| 5,086,959 | A | | 2/1992 | Jerry | |
| 5,121,861 | A | | 6/1992 | Wong | |
| 5,345,641 | A | * | 9/1994 | Webster | 15/105 |
| 5,385,279 | A | | 1/1995 | Dawson | |
| 5,516,015 | A | | 5/1996 | Berzins | |
| 6,132,002 | A | | 10/2000 | Brown | |
| 6,702,163 | B1 | | 3/2004 | Hoppin | |
| 2009/0236377 | A1 | * | 9/2009 | Selvarajah | 223/115 |
| 2011/0089203 | A1 | * | 4/2011 | McNair | 223/114 |
| 2011/0101048 | A1 | | 5/2011 | Moore | |

* cited by examiner

*Primary Examiner* — Nathan Durham
(74) *Attorney, Agent, or Firm* — Daniel L. Fitch, Esq.; Wharton, Aldhizer & Weaver, PLC

(57) ABSTRACT

A combination boot jack, boot tray and boot rack for the removal, cleaning, movement and storage of mud boots, muck boots, galoshes, snow boots, work boots and similar rubber boots. The boot tray is broad enough for a user to step into the top surface of its base with both booted feet. The invention has a pair of U-shaped notches elevated above the top surface of the base, as well as an open-back/closed toe foot box, built into the boot tray. The user may thus step into the boot tray, use the pair of U-shaped notches as a boot jack to grip and secure the heels of both boots at once, and remove them, one at a time. During removal of the second boot, the user's unbooted foot is placed into the protected foot box, keeping it dry and out of contact with the ground, the outside of the boots, or any part of the boot jack and boot tray touched or soiled by the boots during their removal. Further, the boot jack and boot tray may be used as a boot rack for moving a pair of boots from place to place without touching them, as well as for later cleaning or storage.

12 Claims, 8 Drawing Sheets

COMBINATION BOOT JACK, BOOT TRAY, AND BOOT RACK

CROSS REFERENCE TO RELATED APPLICATION

Not Applicable.

FEDERALLY SPONSORED RESEARCH

Not Applicable.

SEQUENCE LISTING PROGRAM

Not Applicable.

FIELD OF THE INVENTION

The present invention relates to a combination boot jack, boot tray and boot rack for the easy removal, cleaning, movement and storage of boots, particularly rubber boots such as mud boots, muck boots, galoshes, snow boots and similar work boots which become fouled or caked with dirt, mud, vegetation, ice, snow or other substances during wear.

BACKGROUND OF THE INVENTION

Traditional boot jacks are used to remove cowboy boots, riding boots and other tall dress boots in a multi-step process. One of the user's booted feet is used to push the boot jack down against a firm supporting surface, thereby holding it in place. The heel of the user's other booted foot is placed in a notch or recess to engage and secure the back of the boot. Typically, the notch or recess is "V"-shaped and angled above or below the horizontal to give the user additional leverage in removing the boot. The user then pulls up on the booted foot which is secured in the notch of the boot jack, while simultaneously pushing down on the boot jack with the other foot. Once the first boot is removed, the process is repeated by switching the position of the user's unbooted foot and booted foot on and in the boot jack. The prior art teaches a variety of boot jacks which provide for the removal of dress boots in this way. For example, U.S. Pat. Nos. 3,964,117; 4,135,652; 5,086,959; 5,385,279; 5,516,015; 6,132,002; and 6,702,163 all teach boot jacks using some variation or combination of this approach. U.S. Pat. No. 5,121,861 teaches an apparatus which reverses the legs which push and pull during the boot removal process.

The prior art focuses on the problem of removing cowboy boots, tall dress boots or similar leather footwear. Implicit in the foregoing prior art is that this removal will occur on a relatively clean surface, usually indoors; with a relatively clean pair of boots, usually tall leather dress boots; in a setting appropriate for comfortably going shoeless, at least for a time, after removal. After use, most boot jacks used in such settings require no cleaning, are not used to store, carry or transport the boots and may be left in a customary place or put away until needed again.

One limitation of such boot jacks is that they are poorly suited for use with wide heeled rubber boots that are worn in very dirty environments such as muck boots used in agricultural settings, mud boots or work boots used in construction and similar outdoor settings, galoshes used in sloppy wet weather settings, or snow boots used in frozen settings. Under such usages, these types of rubber boots often become caked in mud, covered in dirt, encrusted in snow and grit, splashed with concrete or other construction debris, strewn with vegetation, wet or otherwise messy to handle. Removal of such boots using conventional boot jacks poses many difficulties. Many of the devices, for instance, are wholly unfit for use in an outdoor setting, particularly on earth surfaces that are soft, wet, uneven, dirty or muddy. While well adapted for use on manmade surfaces which are dry, hard and level—such devices are typically unstable on soft, uneven or muddy ground. Further, most have an inadequate surface area to distribute and support the full weight of an adult user standing on the boot jack during use in an outdoor setting upon an earth surface. In such environments, many of the boot jacks taught by the prior art would be difficult to keep in an upright configuration, subject to being pushed into or beneath the surface of muddy or wet ground, or tipping over easily when downward force is applied.

Further, while boot jacks having "V"-shaped notches angled to the horizontal are excellent for gripping the sturdy and often narrow heels of leather dress boots, they are ill-suited for gripping the more pliable and often wider heels of softer rubber boots. A wide "U"-shaped notch having a horizontal alignment is preferable for the removal of rubber boots. Further, boot jacks which do have U-shaped notches, while preferable for removing the wider rounded heels of most rubber boots, are generally not suitable for the outdoor removal of dirty boots in messy environments. For instance, typical boot jacks provide a single notch for gripping and removing one boot at a time. After the first boot is removed, the user must step upon the exposed surface of the boot jack with the unbooted foot to push down and hold it in place, all before attempting to remove the second boot. In messy outdoor settings, this can result in the unbooted foot coming into direct contact with dirt, mud, vegetation, ice, snow, construction debris or other unwanted substances. None of the boot jacks teach a broad boot tray suitable for simultaneously placing and supporting both feet of the user into a dual-notched boot jack and allowing the removal of a pair of dirty boots while keeping the user's feet dry and clean. Further, none of the boot jacks teach all of this while the boot tray rests stably upon a variety of earth surfaces that are otherwise ill-suited for such removal, including ground that is soft, wet, uneven, dirty or muddy.

Especially lacking in the prior art is a place for the user to place and protect his unbooted foot within the boot jack after removal of the first boot which also provides a platform to push down upon during removal of the second boot. In addition, after removal of both boots, there is a need for a boot jack to double as a boot tray which can be used to carry dirty boots from place to place without the user touching the boots or any of the debris and contaminants left in the boot tray during removal. Such a boot tray should contain such debris and contaminants within its perimeter until it is cleaned out while allowing the user to lift it with a carrying handle. Additionally a boot jack tripling as a boot rack is needed in order to secure the boots during movement, cleaning and storage. In short, what is needed is a combination boot jack, boot tray and boot rack especially suited for the removal, cleaning, movement and storage of mud boots, muck boots, galoshes, snow boots, work boots and similar rubber boots worn in both indoor and outdoor conditions.

SUMMARY OF THE INVENTION

It is therefore an object of the present invention to provide a boot jack having dual raised notches housed within a broad boot tray capable of use in a wide array of indoor and outdoor settings. The boot tray has a base which is broad enough for an adult user to step into it with both feet while wearing a pair of large rubber boots. The surface area of the boot tray's broad base is capable of supporting the user's weight during the boot removal process without tipping over on uneven ground or sinking into soft earth surfaces. Once the wearer steps into the boot tray, he may engage and secure the heels of both boots into dual U-shaped raised notches for removal. This also allows the user to maintain good balance by placing the boot to be removed on a flat supporting surface, rather than trying to keep his balance with one foot extended away from the boot jack. These U-shaped raised notches are raised above the top surface of the boot tray's base to a height such that they may accept and secure the often pliable heels of rubber boot heels. The boot tray has a raised rim around its perimeter to keep moisture, mud and other debris—which may fall or spill from the boots—from leaking or spilling out of the boot tray. The boot tray also has skid pads on the bottom surface of the base to prevent it from slipping when placed on wet, uneven, or other slippery ground.

The top of the boot tray's base has raised ridges to stabilize the user's boots against slippage and to provide him with additional traction during removal. Integral to the boot tray is an open-back/closed-toe foot box, centered between the U-shaped raised notches of the boot jack. The open-back/closed-toe foot box extends into the center of the boot tray and is enclosed around the toe to keep moisture and other debris, deposited or spilled into the boot tray during removal, from contaminating the user's unbooted foot. The back of the open-back/closed-toe foot box is open to allow the user to insert his unbooted foot into it after he has removed the first boot. In that way, the user can push down on the boot jack and boot tray with his unbooted foot to help remove the second boot. Thereafter, the user can step into other footwear, or, depending on the type of supporting surface (e. g. a dry indoor or outdoor setting), out of the boot tray entirely and onto the surrounding surface without donning other footwear. Both of the user's feet, presumably socked, remain dry and unsoiled during the boot removal process, even when removing the dirtiest pair of boots. Neither of the user's feet comes in contact with the ground, the outside of the dirty boots or any part of the boot tray or boot jack fouled by the boots during their removal.

Another feature of the present invention is a carrying handle, generally centered above the open-back/closed-toe foot box, used for lifting and carrying the boot tray with or without a pair of boots. Especially after their removal, the carrying handle eliminates the user's need to handle the boots directly and allows him to move the dirty boots, still fixed within the boot tray, to a mud room, into a vehicle or elsewhere. The placement of the open-back/closed toe foot box between the U-shaped notches also acts to spread the users booted feet apart once in the boot jack for added stability during their removal. The top surface of the boot tray retains any moisture, debris or other contaminants deposited by the boots within the rim of its raised perimeter. The boot tray may also serve as a boot rack to store a pair of dirty boots until such time as the user is ready to wear them again, transport or clean them. The boot tray's base has raised ridges on its top surface to keep the boots from sliding.

The pair of U-shaped notches has grooves which are raised and designed to receive a pair of U-shaped inserts, preferably made of rubber. Other pliable materials, besides rubber, well known to those in those skilled in the art, may be used to make the U-shaped inserts. The U-shaped inserts are fashioned both to fit tightly within the U-shaped notches and grip firmly the rounded heels of the rubber boots to secure them in position both during and after removal. Several pairs of U-shaped inserts having different thickness are provided to allow the boot jack to accommodate and grip a wide variety of boot sizes. A standard pair of U-shaped inserts is provided for most adult users. Additional pairs of U-shaped inserts may be provided for use with smaller boots, such as those of a child. The plane defined by the top plates, within which the U-shaped notches are formed, is generally parallel to the plane defined by the top surface of the boot tray's base. A keyhole is provided at the rear of the open-back/closed-toe foot box to allow a user to hang the boot tray vertically when it is not in use.

The boots can be cleaned while secured in the boot tray (e.g. by washing them off) or they can be removed individually for separate cleaning. The boot tray may be made of any lightweight material which is water-resistant or water-proof such that it can be washed down with or without the boots still secured therein. After cleaning or after use, the boots can be stored in the boot tray as a boot rack, until they are needed again. Acting as a boot rack, the user may easily transport a pair of boots, secured within the boot tray, from place to place until needed again.

BRIEF DESCRIPTION OF THE DRAWINGS

The accompanying drawings, which are included to provide a further understanding of the invention, are incorporated in and constitute a part of this specification, illustrate examples of the invention, and together with the detailed description, serve to explain the principles of the invention. No attempt is made to show structural details of the invention in more detail than may be necessary for a fundamental understanding of the invention and the various ways in which it may be practiced.

DETAILED DESCRIPTION OF THE DISCLOSURE

Figure 1:
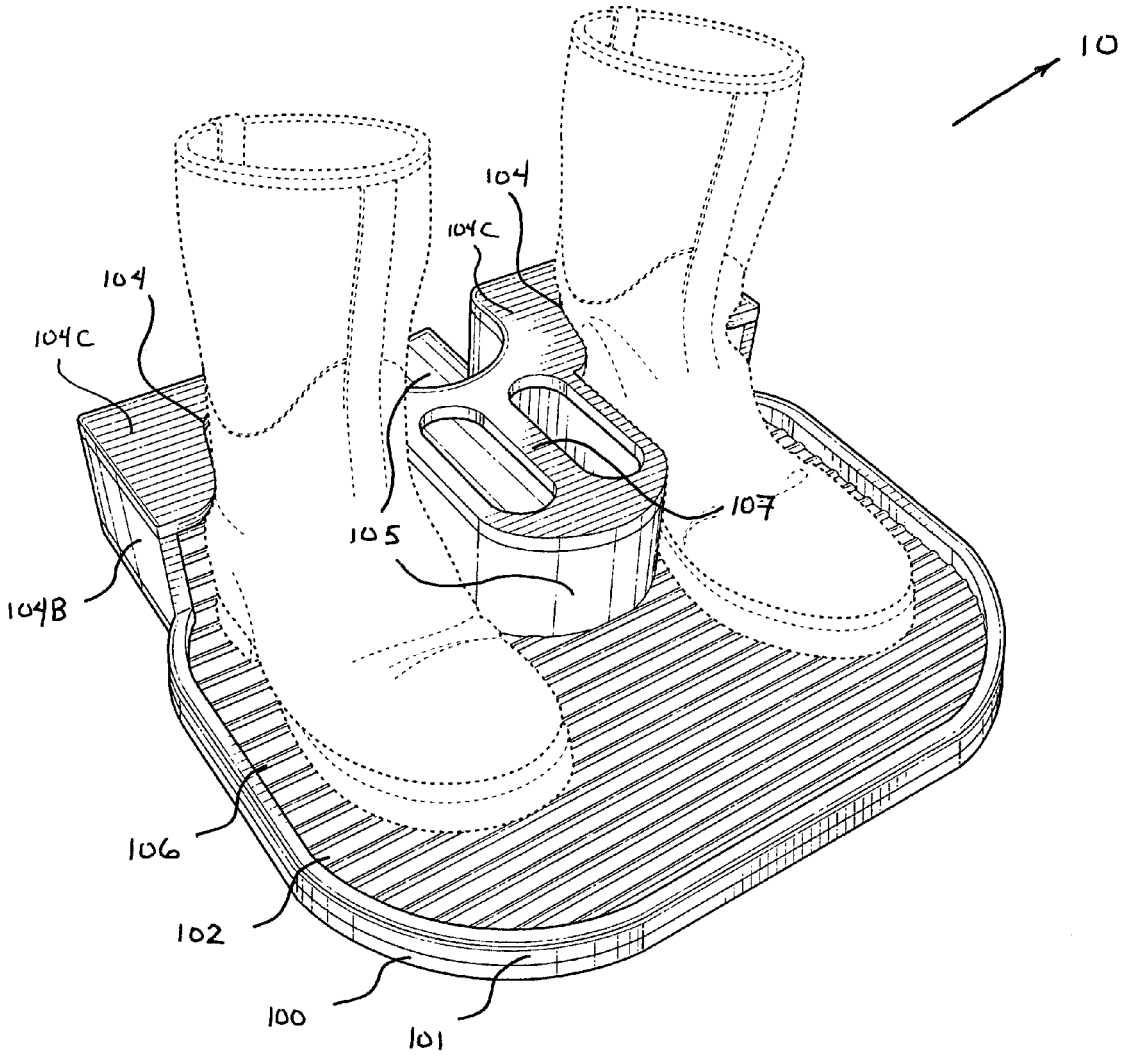
FIG. 1 is a front perspective view of the present invention.
Figure 2:
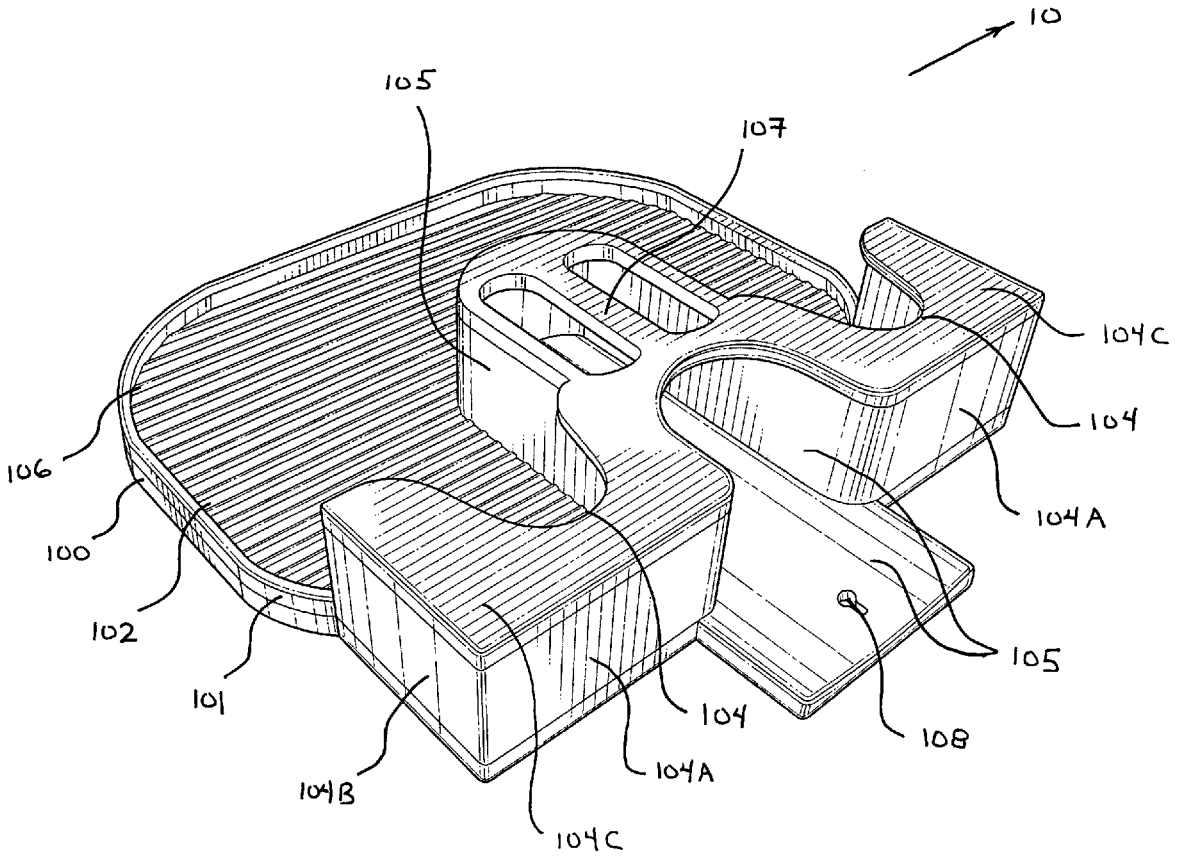
FIG. 2 is a rear perspective view of the present invention.
Figure 3:
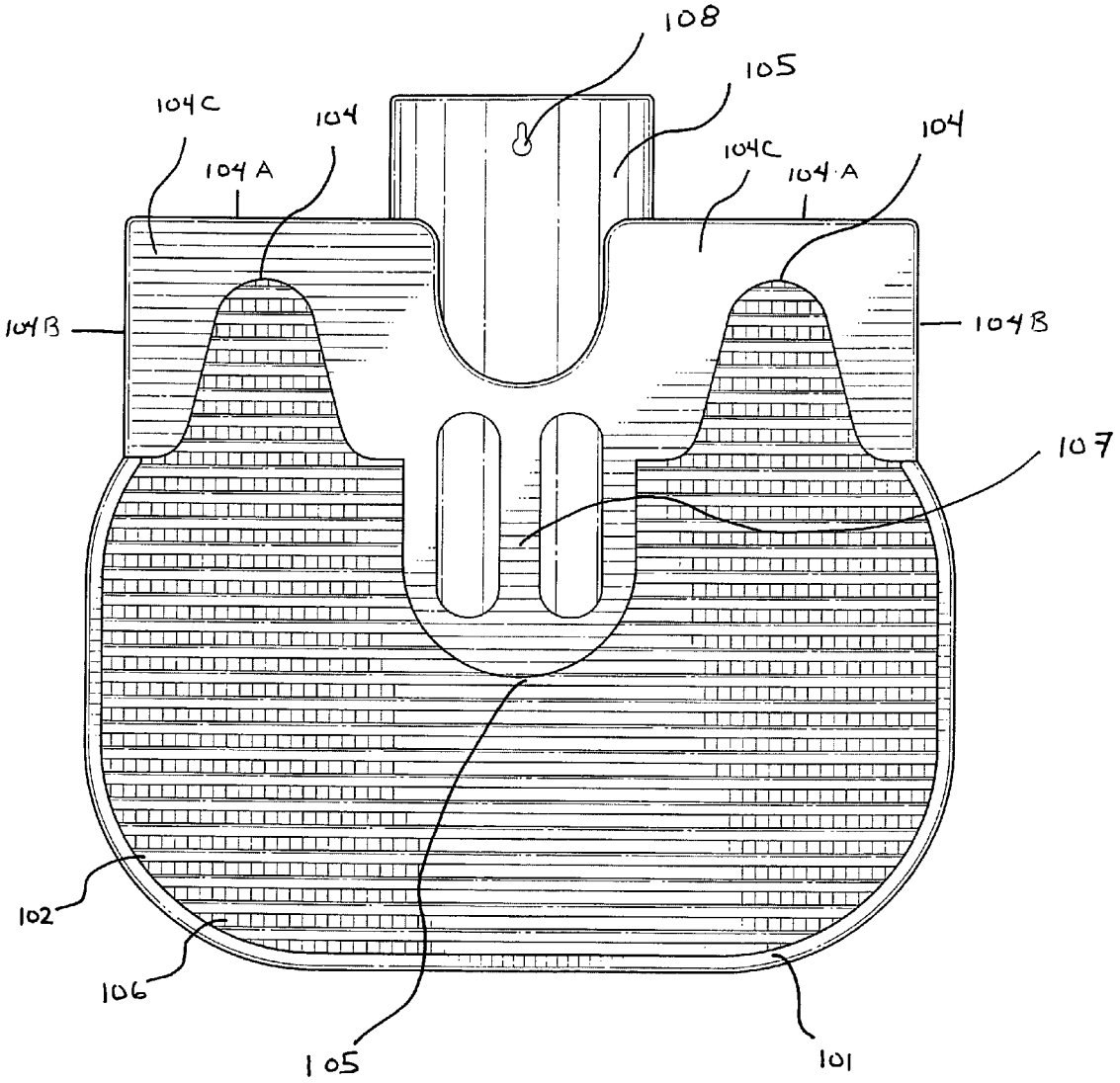
FIG. 3 is a top view of the present invention.

The examples and various features herein and advantageous details thereof are explained more fully with reference to the non-limiting descriptions and/or illustrations in the accompanying drawings and detailed in the following description. It should be noted that the features illustrated in the drawings are not necessarily drawn to scale, and features of one example may be employed with other examples as the skilled artisan would recognize, even if not explicitly stated herein. Descriptions of well-known components and processing techniques may be omitted so as not to unnecessarily obscure the examples of the invention. The examples used herein are intended merely to facilitate an understanding of ways in which the invention may be practiced and to further enable those of skill in the art to practice the examples of the invention. Accordingly, the examples herein should not be construed as limiting the scope of the disclosure, which is defined by the claims and applicable law. Moreover, it is noted that like reference numerals represent similar parts throughout the several views of the drawings.

It is understood that the invention is not limited to the particular methodology, devices, apparatus, materials, applications, etc., described herein, as those may vary. It is also to be understood that the terminology used herein is used for the purpose of describing particular examples only, and is not intended to limit the scope of the disclosure. It is further noted that as used herein and in the appended claims, the singular forms "a", "an", and "the" include plural references unless the context clearly dictates otherwise.

Unless defined otherwise, all technical and scientific terms used herein have the same meanings as commonly understood by one or ordinary skill in the art to which this invention belongs. Preferred methods, devices, and materials are described, although any methods and materials similar or equivalent to those described herein can also be used.

With reference now to the drawings, in general, and to FIGS. 1 through 10, in particular, a combination boot jack, boot tray and boot rack embodying the teachings of the subject invention is generally designated as 10. With reference to FIGS. 1 through 10, the combination boot jack, boot tray and boot rack 10 includes a base 100 surrounded by a raised rim 101 forward of the side plates 104B. The base 100 has a top surface 102 and a bottom surface 103. A pair of U-shaped raised notches 104 is situated as shown on and above the top surface 102 of the base 100. The top plates 104C, in which the U-shaped raised notches 104 are formed, are elevated by back plates 104A and side plates 104B. The plane formed by the top plated 104C is elevated above the plane of the top surface 102 and generally parallel to it. The pair of U-shaped raised notches 104 is closed to the rear and open to the front of the invention as shown. Centered between the U-shaped raised notches 104 is an open-back/closed-toe foot box 105. The raised rim 101, back plates 104A, side plates 104B and closed-toe portion of the open-back/closed-toe foot box 105 define an enclosed perimeter of the top surface 102 of the base 100. This enclosed perimeter acts as a retention basin to contain moisture, mud and other debris, deposited or spilled in the tray during boot removal within this perimeter. In an alternate embodiment, the raised rim may be eliminated, however, in so doing; the retention basin described herein is partially compromised.

Raised ridges 106 covering the top surface 102 of the base 100 serve to stabilize the boots and give traction to the user during boot removal, as well as to stabilize the boots within the boot rack after their removal. In other embodiments, a non-skid material may be applied to the top surface of the base. A carrying handle 107 is provided to enable the user to lift and carry the invention from place to place, with or without boots resting therein. While the preferred embodiment is shown, other carrying handles well known to those skilled in the art may be substituted (e. g. a raised carrying handle). The carrying handle 107 is emplaced above the open-back/closed-toe foot box to keep the user's lifting hand out of contact with contaminants. A keyhole 108 is provided at the rear of the open-back/closed toe foot box 105 to hang the invention vertically when it is not in use. In its preferred embodiment, the invention is constructed of a lightweight material which is either waterproof (e. g. plastic) or water resistant (e.g. pressure treated wood).

Figure 4:
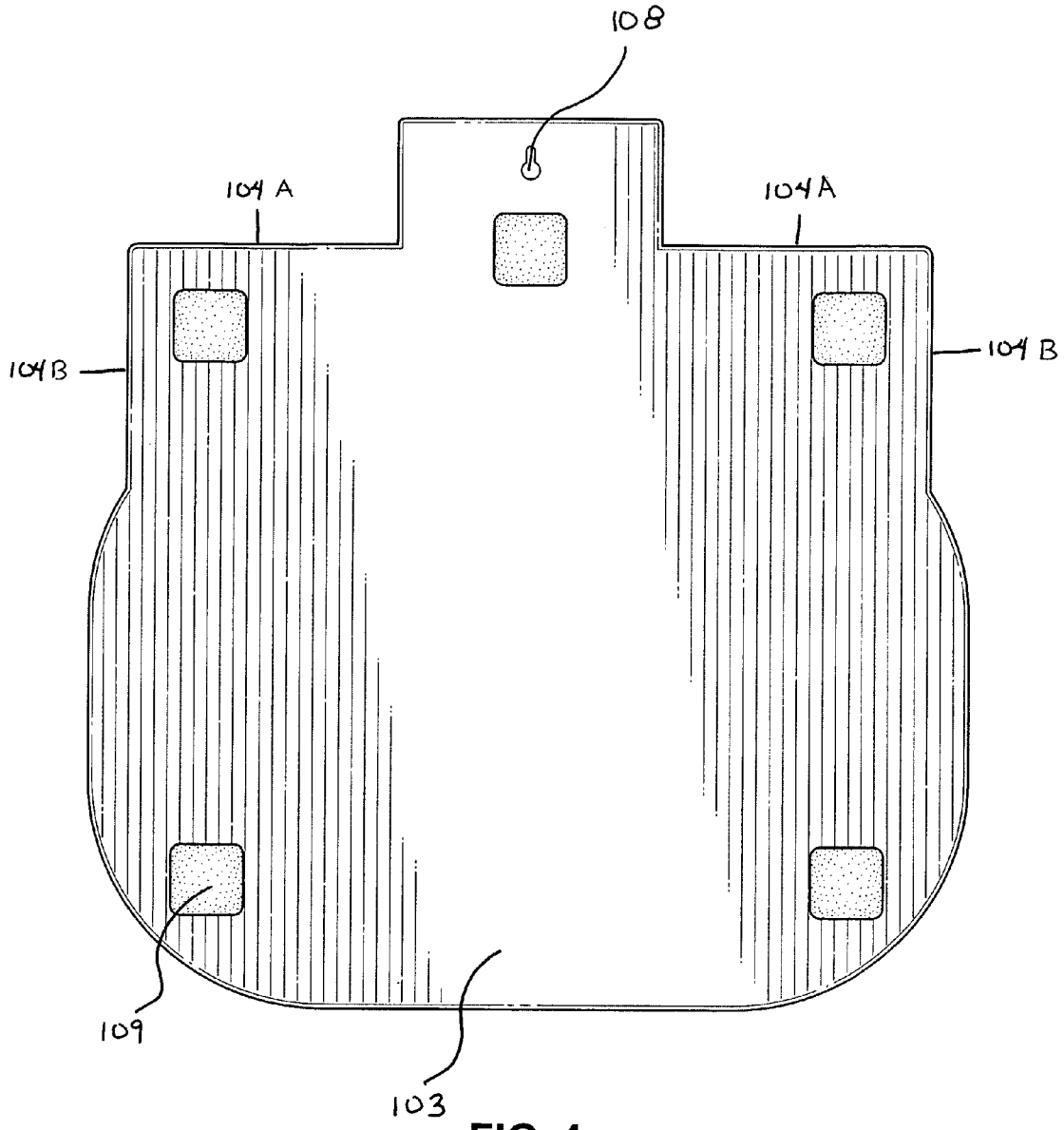
FIG. 4 is a bottom view of the present invention.
Figure 5:
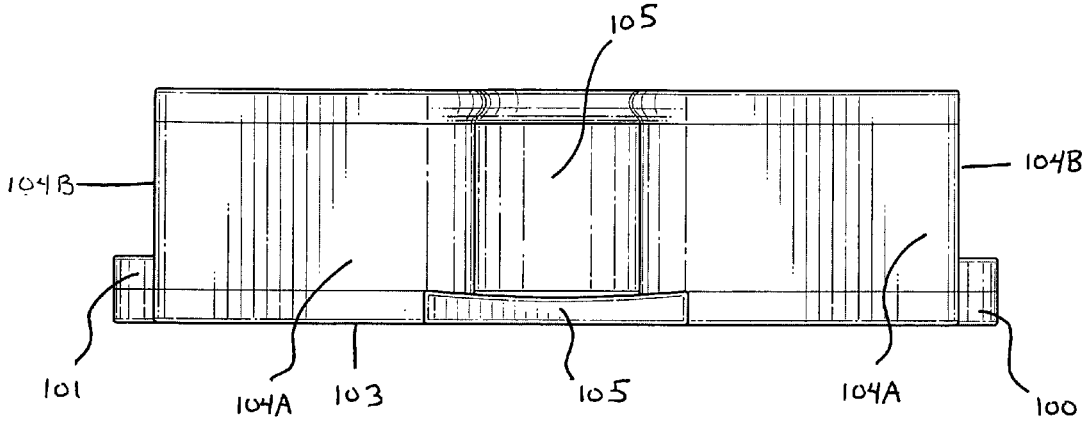
FIG. 5 is a rear view of the present invention.
Figure 6:
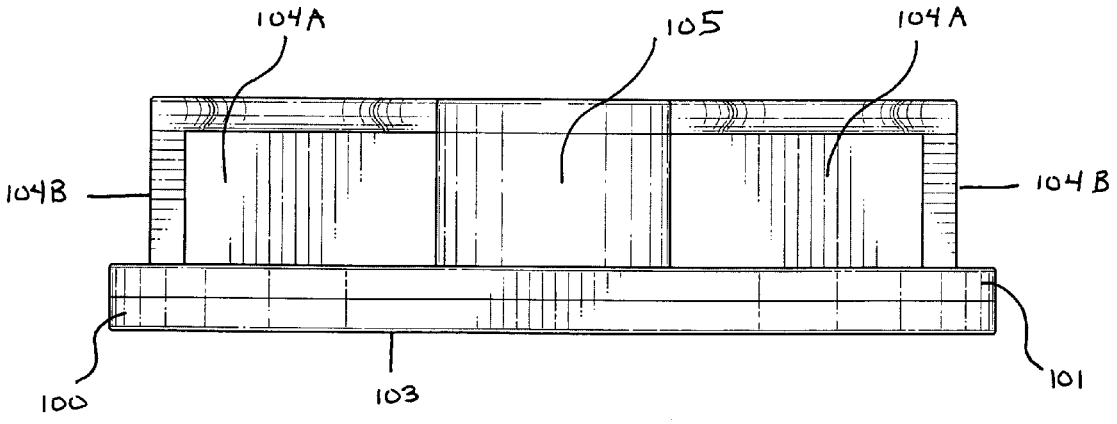
FIG. 6 is a front view of the present invention.
Figure 7:
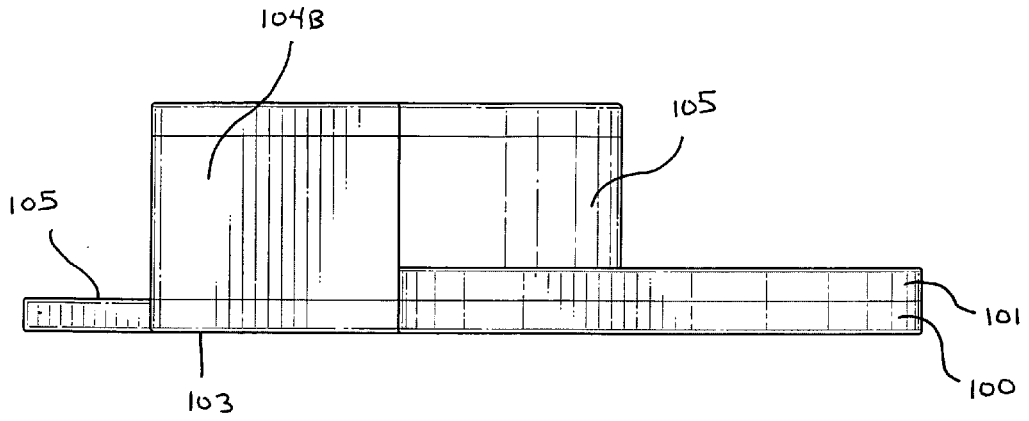
FIG. 7 is a right side view of the present invention.
Figure 8:
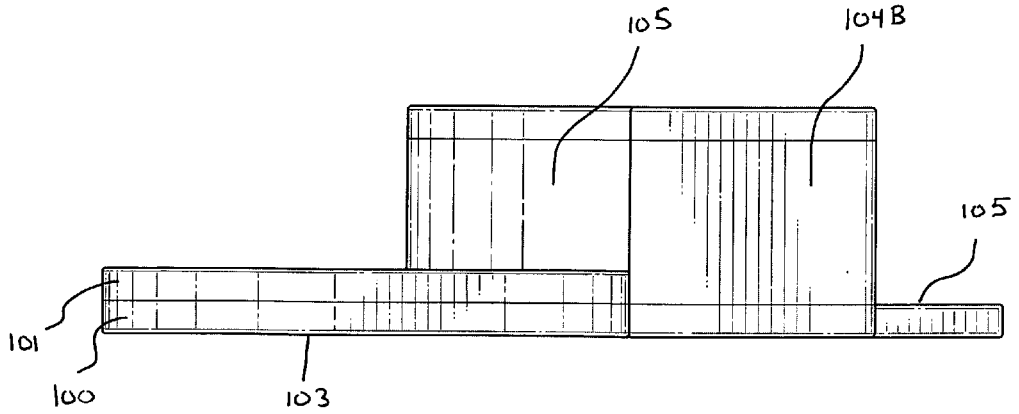
FIG. 8 is a left side view of the present invention.
Figure 9:
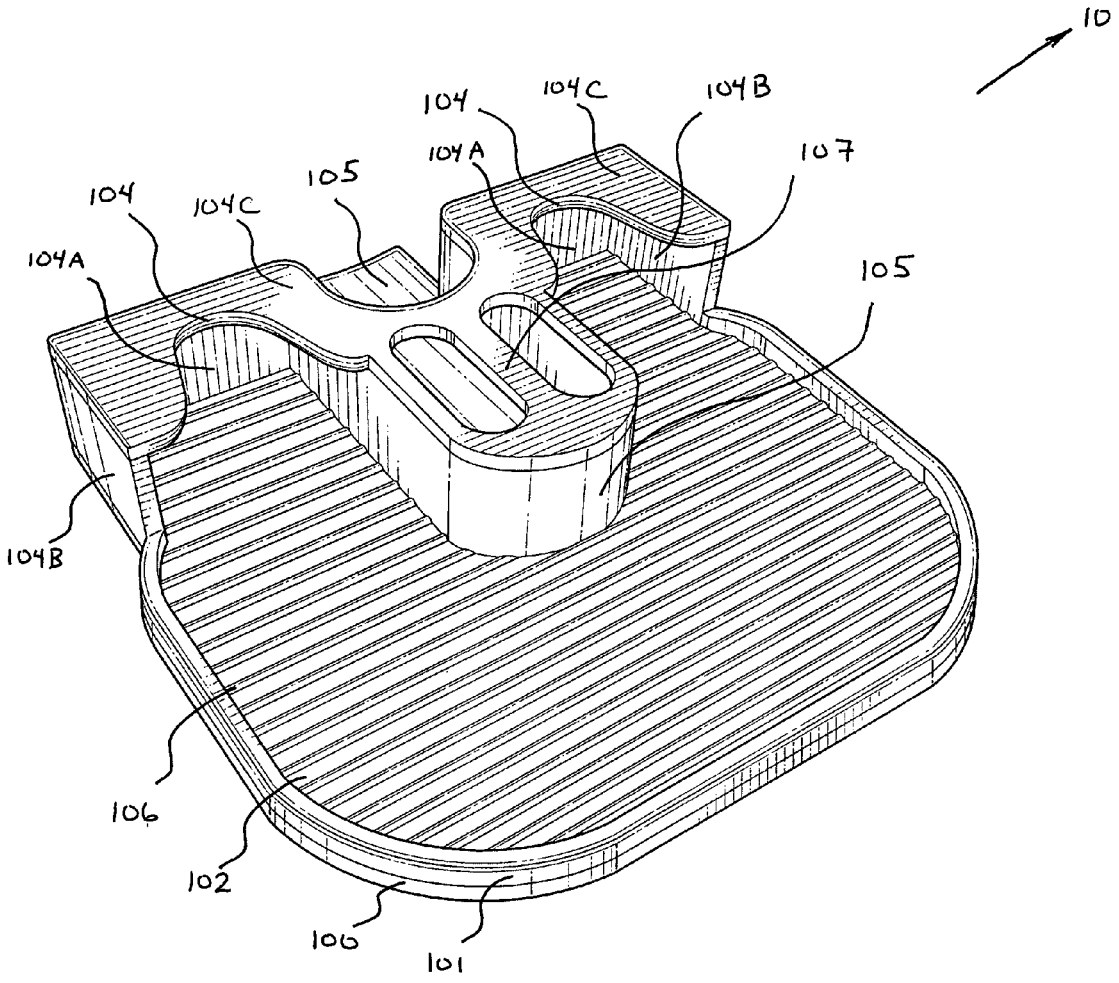
FIG. 9 is a front perspective view of the present invention without the U-shaped inserts fitted within the raised U-shaped notches.

FIG. 4 shows skid pads 109 used to provide friction and stabilize the boot tray against movement on various supporting surfaces during use. In other embodiments, different configurations or numbers of skid pads may be used.

FIGS. 1, 2, 3, 5, 6, 7, 8, 9, and 10 show the open-back/closed-toe foot box 105 which provides a protected place for the user to put his dry foot into after removal of the first boot. The open-back/closed-toe foot box 105 is enclosed around the toe and mid-sole area of the user's foot as shown to keep the unbooted foot from coming into contact with moisture, mud or other debris on the top surface 102 of the base 100. The back of the open-back/closed-toe foot box 105 is elevated and beveled to keep moisture from entering it during use.

Figure 10:
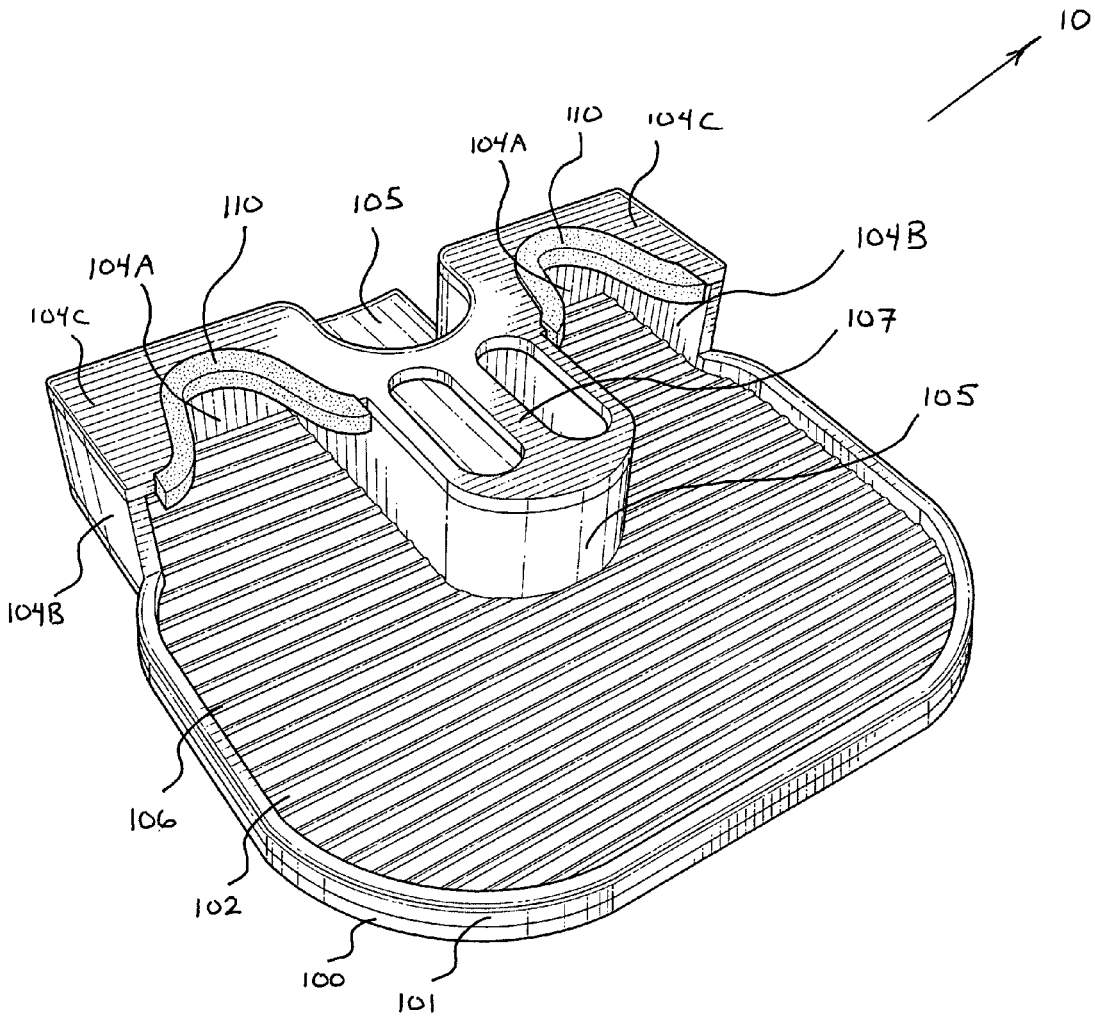
FIG. 10 is a front perspective view of the present invention showing the U-shaped inserts fitted within the raised U-shaped notches.

FIG. 10 shows a pair of U-shaped inserts 110 fitted within the U-shaped notches 104 to accommodate and accept a variety of boot heel sizes, such as those of adult and children. Several pair of U-shaped inserts 110 may be provided to allow the invention to be used to fit and grip a wide variation in boot size. In the preferred embodiment, the U-shaped inserts 110 are made of rubber.

We claim:

1. A combination boot jack, boot tray and boot rack comprising:

a base having a top surface and bottom surface;

a pair of U-shaped notches formed within a pair of top plates, said top plates elevated above said top surface by side plates and back plates such that said U-shaped notches are configured to receive the heels of a pair of boots;

a pair of U-shaped inserts seated within said pair of U-shaped notches which are configured to fit and grip a plurality of boot heel sizes and which function to create friction when in contact with the heel of a user's booted foot;

a foot box, located between said pair of U-shaped notches, having an open-back and closed-toe, which functions to keep a user's unbooted foot dry, said foot box defining a chamber within which the user's unbooted foot is placed;

a carrying handle cut into the top of said foot box;

a raised rim around the perimeter of said base's top surface and forward of said side plates, said raised rim, back plates, side plates and closed-toe portion of the foot box defining a retention basin.

2. The combination boot jack, boot tray and boot rack of claim 1, wherein the said top surface has raised ridges.

3. The combination book jack, boot tray and boot rack of claim 2 wherein the bottom surface has skid pads.

4. The combination boot jack, boot tray and boot rack of claim 1 wherein, the said top surface is covered with a non-skid material.

5. The combination book jack, boot tray and boot rack of claim 4 wherein the bottom surface has skid pads.

6. The combination book jack, boot tray and boot rack of claim 1 wherein the bottom surface has skid pads.

7. A combination boot jack, boot tray and boot rack comprising:

a base having a top surface and bottom surface;

a pair of U-shaped notches formed within a pair of top plates, said top plates elevated above said top surface by side plates and back plates such that said U-shaped notches are configured to receive the heels of a pair of boots;

a pair of U-shaped inserts seated within said pair of U-shaped notches which are configured to fit and grip a plurality of boot heel sizes and which function to create friction when in contact with the heel of a user's booted foot;

a foot box, located between said pair of U-shaped notches, having an open-back and closed-toe, which functions to keep a user's unbooted foot dry, said foot box defining a chamber within which the user's unbooted foot is placed;

a carrying handle cut into the top of said foot box.

8. The combination boot jack, boot tray and boot rack of claim 7, wherein said top surface has raised ridges.

9. The combination boot jack, boot tray and boot rack of claim 8 where the bottom surface has skid pads.

10. The combination boot jack, boot tray and boot rack of claim 7, wherein said top surface is covered with a non-skid material.

11. The combination boot jack, boot tray and boot rack of claim 10 where the bottom surface has skid pads.

12. The combination boot jack, boot tray and boot rack of claim 7 where the bottom surface has skid pads.

* * * * *